US005643159A

United States Patent [19]

Iavarone

[11] Patent Number: 5,643,159

[45] Date of Patent: Jul. 1, 1997

[54] THERAPEUTIC EXERCISE DEVICE

[75] Inventor: Jerry A. Iavarone, 1250 W. Lake St., Addison, Ill. 60101

[73] Assignee: Jerry A. Iavarone, Addison, Ill.

[21] Appl. No.: 603,786

[22] Filed: Feb. 20, 1996

[51] Int. Cl.[6] ..... A63B 21/02

[52] U.S. Cl. ..... 482/125; 482/126; 482/79

[58] Field of Search ..... 482/121, 122, 482/124, 125, 126, 129, 79, 907

[56] References Cited

U.S. PATENT DOCUMENTS

| | | | |
|---|---|---|---|
| 843,487 | 2/1907 | Muller . | |
| 2,919,134 | 11/1959 | Zuro . | |
| 3,162,441 | 12/1964 | Karlik . | |
| 4,121,827 | 10/1978 | Weider . | |
| 4,251,071 | 2/1981 | Norton | 482/125 |
| 4,304,402 | 12/1981 | Ripp . | |
| 4,728,103 | 3/1988 | Fulton | 482/125 |
| 4,815,731 | 3/1989 | Suarez et al. . | |
| 4,909,505 | 3/1990 | Tee | 482/129 |
| 5,125,649 | 6/1992 | Fuller . | |
| 5,137,503 | 8/1992 | Yeh et al. . | |
| 5,167,601 | 12/1992 | Frappier . | |
| 5,186,701 | 2/1993 | Wilkinson . | |
| 5,197,934 | 3/1993 | Wirtz . | |
| 5,203,754 | 4/1993 | Maclean | 482/124 |
| 5,263,916 | 11/1993 | Bobich . | |
| 5,318,494 | 6/1994 | Santighian . | |
| 5,336,151 | 8/1994 | Ballegooie . | |
| 5,372,565 | 12/1994 | Burdenko . | |

FOREIGN PATENT DOCUMENTS

| | | | |
|---|---|---|---|
| 458831 | 10/1913 | France | 482/125 |

*Primary Examiner*—Lynne A. Reichard
*Attorney, Agent, or Firm*—Michael, Best & Friedrich

[57] ABSTRACT

A therapeutic exercise device is provided having an adjustable ankle harness, multiple elastic elements of varying resistance, an adjustment device to further adjust tension development on the elastic elements, and handles or handles in conjunction with an elongated bar. The adjustable ankle harness has a quick release ankle harness fastener on the portion which circumscribes the ankle. The ankle harness has a loop portion which is positioned under the heel and attachment loops for attaching the elastic elements. Each elastic element has a quick release fastener at each end which connects the elastic element to an attachment loop of the ankle harness and a handle at the opposite end. Multiple elastic elements may be used simultaneously for planar alignment of the particular joint, limb, or muscle being exercised. Further, elastic elements having variable resistannce or lengthwise tension may be simultaneously used. A substantially rigid elongated bar may be used with the device, includieng rings or grooves adapted to receive one end of the elastic element. The elongated bar may be held in place as a point of origin from which to extend the elastic elements.

14 Claims, 2 Drawing Sheets

THERAPEUTIC EXERCISE DEVICE

BACKGROUND OF THE INVENTION

The present invention relates to the field of exercise devices, and more particularly, to therapeutic exercise devices which are used for the gradual rehabilitation of injured muscles or joints where range of motion and or proper alignment issues are of concern.

Exercise devices and particularly those utilized in springs or elastic elements are old in the art. Accordingly it is uncontroverted that exercise has beneficial effects and most devices within this field have the purpose of capitalizing on the beneficial effects while attempting to make exercises simpler, more complete and universal. However, none of the prior art devices are concerned with the particularities of exacting the therapy required for successful rehabilitation from injury. Many prior art devices do not allow for the prescribed planar alignment of limbs and joints being exercised. Nor do these devices provide for gradual increases in range of motion and strength.

Other devices require the use of a bar and a foot holder between which elastic elements or spring elements are connected. However, these devices do nothing to provide means to consistently maintain a limb in proper alignment while performing the exercise. Further, these devices do not provide for gradual increases in tension development through the use of multiple types of elastic elements, differing numbers of elastic elements, and elements of varied elasticity.

Still other devices in the prior art are concerned with having a simple and one piece exercise device. However, like the exercise devices mentioned above, any variability in the exercise is provided by the user and not the device. U.S. Pat. No. 4,121,827, discloses a molded one piece elastic exercise device having a Y-shape with a loop at the truck of the Y and a loop at the end of each branch of the Y. This device allows the user to insert their hands or feet into the loops in order to perform the exercise. However, here, there is no concern with gradual increases in the available tension or with the proper alignment of the joint or muscle being used. This prior art device is also far more limited in the range and types of therapeutic movements obtainable by use of the device.

Some devices do utilize multiple elastic elements as in U.S. Pat. No. 5,197,934. However, even in that device there is no concern with proper alignment or the fine tuning required in rehabilitative therapy.

SUMMARY OF THE INVENTION

Accordingly, it is an object of the present invention to provide a therapeutic exercise device which allows a user to maintain proper alignment of joints or muscles during therapy.

It is a further object of the present invention to provide a therapeutic exercise device which provides for gradual increases in the level of tension encountered in the exercise over the course of therapeutic treatment.

It is another object of the present invention to provide a therapeutic exercise device which provides the use of multiple elastic elements, such as cords, tubes, tapes, ribbons, strips, bands, ropes, or other elastic materials. Each elastic element may be of varying resistance or elasticity to allow for gradual increases in tension development required for persons in rehabilitative therapy.

It is an additional object of the present invention to provide a wide range of exercises that can be accomplished using this device. To this end, and in accordance with the present invention, there is provided a therapeutic exercise device having an adjustable ankle harness, multiple elastic elements of varying resistance or elasticity and either a handle or a means for attaching a handle. This device may also be used in conjunction with an elongated bar to further enhance the range of exercises that are possible with the present device.

The adjustable ankle harness has a quick release ankle harness fastener such as cooperating hooks and loops on the harness which is sized to circumscribe the ankle and a loop portion which is positionable under a heel. The adjustable ankle harness also has at least one attachment loop connected to it. Each elastic element has a quick release elastic element fastener, such as a clip, at one end which connects an attachment loop of the ankle harness and a handle at the opposite end. Multiple elastic elements may be used simultaneously. The device provides for planar alignment of the particular joint or limb of the person undergoing therapy. Further, multiple elastic elements with differing amounts of resistance or elasticity may be used simultaneously. An adjustment device may be used to vary the length, and therefore the tension of the elastic element. The adjustment device may consist of a buckle which is used to shorten or lengthen the elastic element accordingly. The elongated bar may be static or telescopic and have grooves therein which are adapted to receive the handles located at the end of each elastic element. The elongated bar may be held by the person undergoing therapy or may be fixed in a doorway or behind a chair's legs as a point of origin from which to extend the elastic elements away from the fixed elongated bar.

The above and other objects, features, and advantages of the invention will become clear from the following description of the preferred embodiment thereof taken in conjunction with the accompanying drawings.

DETAILED DESCRIPTION OF THE DRAWINGS

Figure 1:
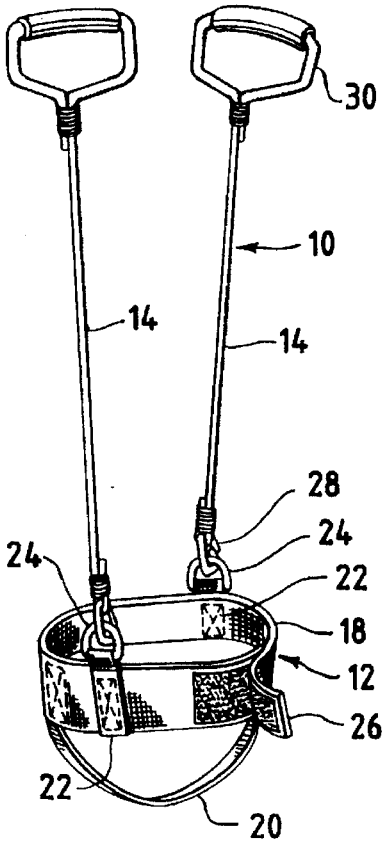
FIG. 1 is a perspective view of a therapeutic exercise device according to the invention.

Making reference now to the drawings, FIG. 1 is a perspective view of the therapeutic exercise device. FIG. 1 shows a therapeutic exercise device 10 having an adjustable ankle harness 12, elastic elements 14, and fastening elements on the ankle harness 12.

The adjustable ankle harness 12 is comprised of an ankle band 18, and heel loop 20. The ankle band 18 and heel loop 20 which are preferably removably fastenable to the ankle area by means of a fastening device 26. In a preferred embodiment, the ankle harness 12 is made from heavy duty nylon fabric and has a Velcro fastener 26. However, in other embodiments the ankle band 18 and heel loop 20 may be manufactured from any strong and sanitary materials commonly known to one skilled in the art.

The adjustable ankle harness 12 also comprises an attachment loop 24, and a quick release ankle harness fastener 26. The attachment loop 24 is connected to ankle harness 12 such that the attachment loop 24 is relatively movable while attached and thus operates to provide a secure attachment of the elastic elements 14 to the loop 24 and to prevent entanglement of the elastic elements 14. In a preferred embodiment of the present invention, there are two or more attachment loop 24 pairs. In other preferred embodiments, the entire ankle band 18 is provided with multiple attachment loop 24 combinations.

In another embodiment of this invention, a reinforced strip 22 may be sewn or otherwise secured to the ankle harness 12 to provide a high degree of structural integrity to the ankle harness 12. The reinforced strip 22 also provides a means for attaching the fastening loop 24 to the ankle harness 12.

It is the structural integrity of the ankle harness 12 in combination with the alignment of the attachment rings 24 in conjunction with the elastic elements 14 that provides a proper alignment for exercises that can be directed to very specific muscle groups.

The handle elements, shown at 30, also provide for alignment of the elastic elements 14. These elements are configured to ensure that the user will maintain a specific planar alignment in using the device by means of the relation of the angle of the handle 30 to the attachment loop 24 that is further controlled in position by the attachment loop 24 for each elastic element 14 employed.

It is the combination of the alignment of these elements that ensures the proper use and alignment of the exercise device. The alignment of the body part as accomplished by the present invention which allows for the proper therapeutic alignment necessary for effective treatment. In a preferred embodiment, the attachment pairs of elastic elements 14 are located so as to provide for the offsetting development of tension when the elastic elements 14 are pulled. Further, the capability of providing multiple elastic elements 14 attached to the same ankle harness 12 is an important factor in providing the user with the ability to exercise different individual muscles or specific muscle groups. Lastly, the adjustable ankle harness 12 is provided with a quick release ankle harness fastener 26 such that a user of the therapeutic exercise device can easily remove the device at the completion of therapy. In one preferred embodiment of the invention, the quick release ankle harness fastener 26 is made from common hook and loop type fasteners such as VELCRO®.

The elastic elements 14 are also provided with a quick release elastic element fastener 28 at one end and a handle 30 at a second end. In one preferred embodiment of the invention, the quick release elastic element fastener may be a plastic C-clip configured to fit the elongated bar 44 or configured to cooperatively attach to a handle element 30.

Figure 2:
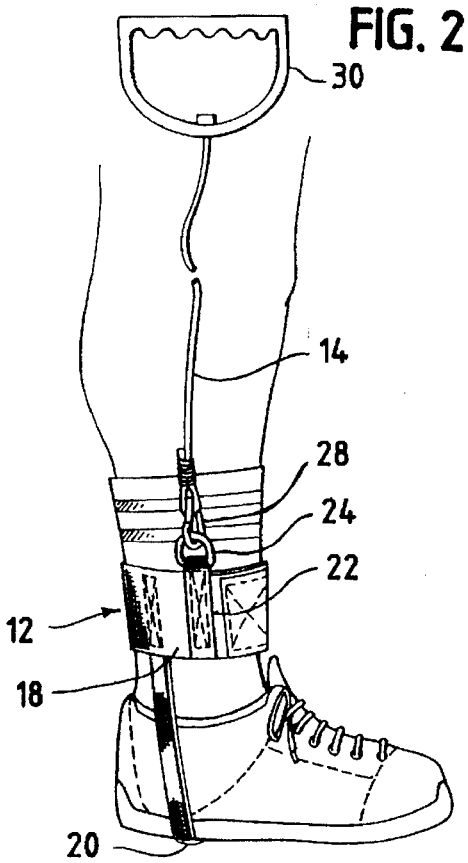
FIG. 2 is a side view of a therapeutic exercise device as it would be worn on the leg of a user.

However, other common attachment devices are contemplated as within the scope of the invention and as would be known by one skilled in the art. The handle 30, as shown in FIG. 1, may be a loop formed from the elastic element 14. In other embodiments, such as that shown in FIG. 2, the handle 30 comprises a swivel handle which is attached to the end of the elastic element 14 and may be made from hard plastic or other suitable material. In a preferred embodiment of the present invention, the elastic elements 14 are comprised of rubber or latex elastic tubing.

Since it is an important purpose of the present invention to provide for the specific tensions, depending upon the treatment protocol, other gradually increasing tensions may be employed through the selection of a different elastic tubing. This results in gradual tension development, not only is the use of multiple elastic elements 14 an important factor but the use of elastic elements 14 having variable resistance or elasticity is also an important factor. The following table shows a representative selection elastic element which are contemplated as within the scope of the invention:

TABLE 1

| Extended Length (inches) | Thin Yellow | Medium Red | Heavy Green | Extra Heavy Blue | Special Heavy Black | Super Heavy Gray |
|---|---|---|---|---|---|---|
| 14 | .50 | 1.25 | 2.0 | 2.5 | 3.0 | 4.75 |
| 16 | .75 | 2.0 | 2.75 | 3.25 | 4.25 | 6.5 |
| 20 | 1.0 | 3.25 | 3.75 | 5.0 | 6.0 | 9.25 |
| 24 | 1.25 | 4.0 | 4.5 | 6.0 | 7.75 | 12.0 |
| 28 | 1.50 | 4.25 | 7.0 | 7.25 | 9.5 | 14.0 |
| 32 | 1.75 | 5.25 | 8.25 | 8.5 | 10.5 | 16.5 |
| 36 | 2.0 | 6.25 | 9.25 | 9.75 | 12.5 | 18.5 |

The above table shows that in situations where the use of minimal tension development is required due to the therapeutic requirements of a particular patient, elastic elements from the left side of the table would be chosen as the elastic element of choice. Whereas upon increases in the range of motion and strength of a particular limb under rehabilitation, one or more elastic elements taken from the middle to right side of the table may be chosen in accordance with a particular therapeutic result. Thus through the use of elastic elements having varying resistance, a gradual increase in tension development can be achieved in the present invention.

Each of the elastic elements listed in Table 1 are shown with a force required to double the length of the elastic element during the use of the invention. This force can range, for example, from about 1 pound to about 5 pounds for the low tension elastic element or about 6 pounds to about 12 pounds for a high tension elastic element. Many other ranges of tension may be applied using this invention. The tension configurations that are possible with this invention are numerous. The variation in range of tension is provided by substitution of elastic elements throughout a range of variable tensions.

Figure 3:
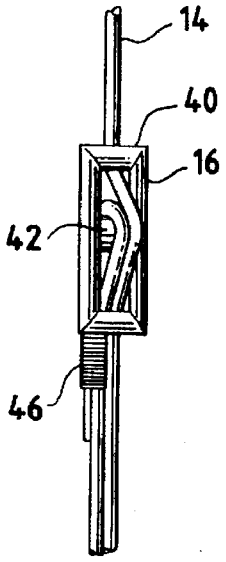
FIG. 3 is an enlarged view of an adjustment device used on a therapeutic exercise device.

FIG. 3 is an enlarged perspective view of the adjustment device 16. In the preferred embodiment of the present invention shown in FIG. 3, the adjustment device 16 comprises a length adjustment buckle having a frame 40 and a resistance portion 42. The frame 40 is constructed from a piece of rigid material such as plastic or metal and has material removed from a central portion thereof. The resistance portion 42 is manufactured from the same starting block of material as the frame 40 and separates the two apertures created where material was removed from frame 40. It should be noted that the adjustment device 16 must be strong enough to withstand the stresses encountered during use of the therapeutic exercise device 10 and must also have the capability of maintaining any lengthening or shortening of the elastic element 14 during exercise without damaging the elastic elements 14. In other preferred embodiments, the adjustment device 16 comprises a spool or spring loaded device which allows for the shortening or elongation of the elastic element 14 and also allows for the adjustment device 16 to lock into place upon the choosing of a particular and appropriate length.

Figure 4:
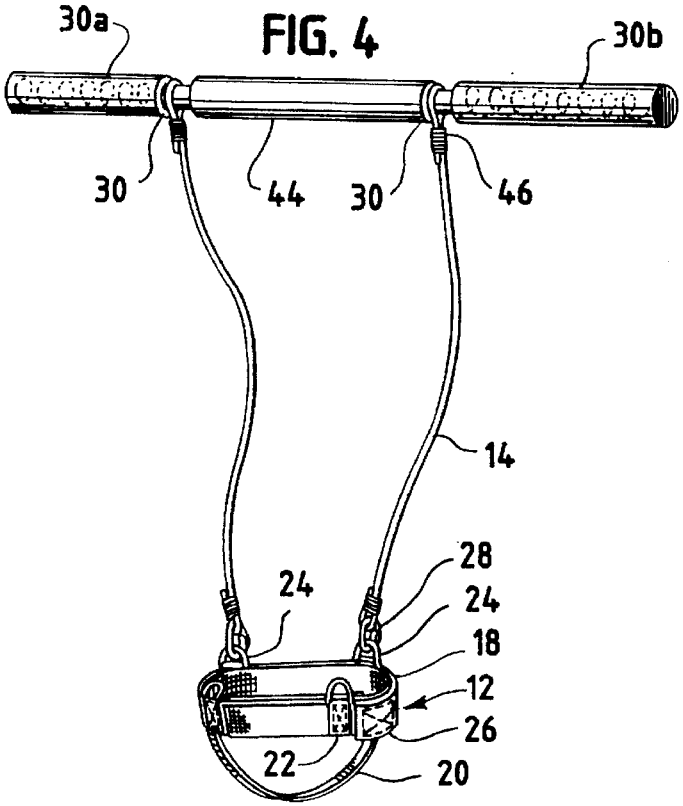
FIG. 4 is a perspective view of an embodiment of the present therapeutic exercise device showing how the elongated bar is cooperatively associated with the handle elements of the elastic elements.

FIG. 4 is a perspective view of the therapeutic exercise device 10 showing the use of the adjustable ankle harness 12, elastic elements 14, adjustment device 16, and handles 30 in conjunction with an elongated bar 44. In this preferred embodiment of the present invention, the elongated bar 44 has fixed rings or grooves 46 which are adapted to receive the handles 30 and a spring-loaded mechanism 30*a*, 30*b*, disposed within the elongated bar 44.

Figure 5:
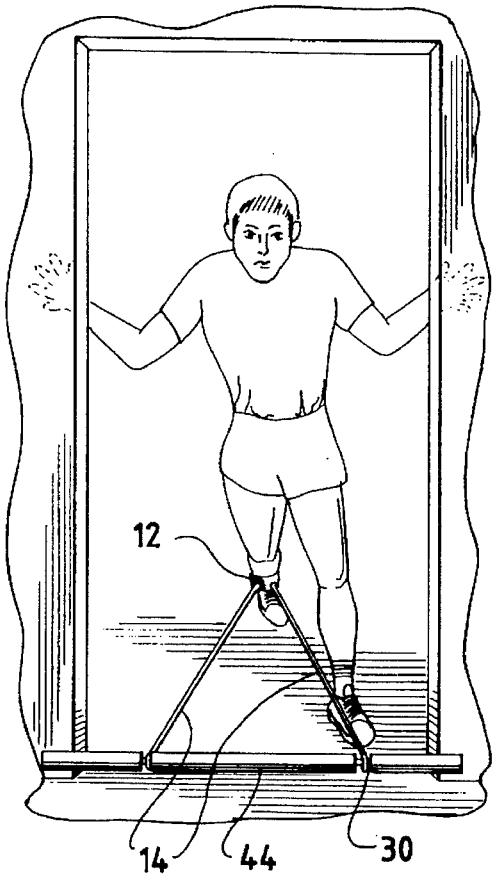
FIG. 5 is a perspective view of an embodiment of the present therapeutic exercise device showing how the elongated bar is cooperatively associated with the handle elements and fixed behind a doorway.

Accordingly, in particular situations, the user may not wish to or may be physically unable to use the handles or the elongated bar alone but instead may find it easier to use the elongated bar placed in a doorway (FIG. 5) or to fit the elongated bar 44 under the legs of a chair for particular exercise protocols.

Further, the elastic element 14 can be attached to a quick release elastic element fastener 28, designed to removably attach the elastic element 14 to the elongated bar 44. Alternatively flexible rings may be used to allow the elastic element 14 to cooperatively function with the elongated bar 44. In these instances, the flexible rings may be permanently affixed to the elastic element in a manner similar to a handle 30. The attachment device 28 is configured to slide about the length of the bar and be fixed in a position which corresponds to the users needs. In this embodiment, the user can temporarily anchor the handles to a stationary object, the elongated bar 44, and thus truly focus on providing the proper alignment for a hip, leg or knee exercise without the distractions which might be caused by requiring the user to maintain a strong grip on the handles 30.

Alternatively, the elongated bar 44 may be grasped in the hand of the user, and the resistance provided by the user's body be employed in the performance of an exercise regime.

Figure 6:
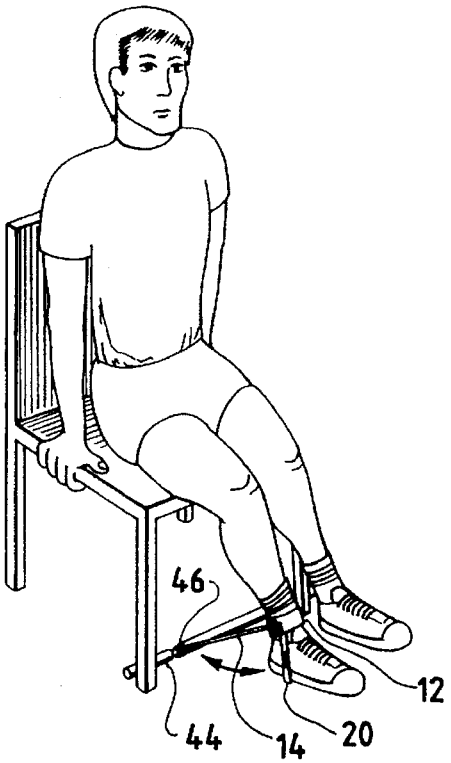
FIG. 6 is a perspective view of an embodiment of the present therapeutic exercise device showing how the elongated bar is fixed behind the legs of a chair while the user is sitting in the chair.

FIG. 6 is a perspective view of an embodiment of the present therapeutic device showing how the elongated bar 44 is fixed behind the legs of a chair. This allows the exerciser to sit on the chair and put ankle harness 12 on and exercise the lower half of his or her body.

Thus, even in embodiments utilizing a stationary point of tension development, the three important factors of using multiple elastic elements, using elastic elements of variable resistance, and providing an adjustment device provide the fine tuning necessary for therapeutic exercise where proper alignment and gradual increase in tension development is critical.

Figure 7:
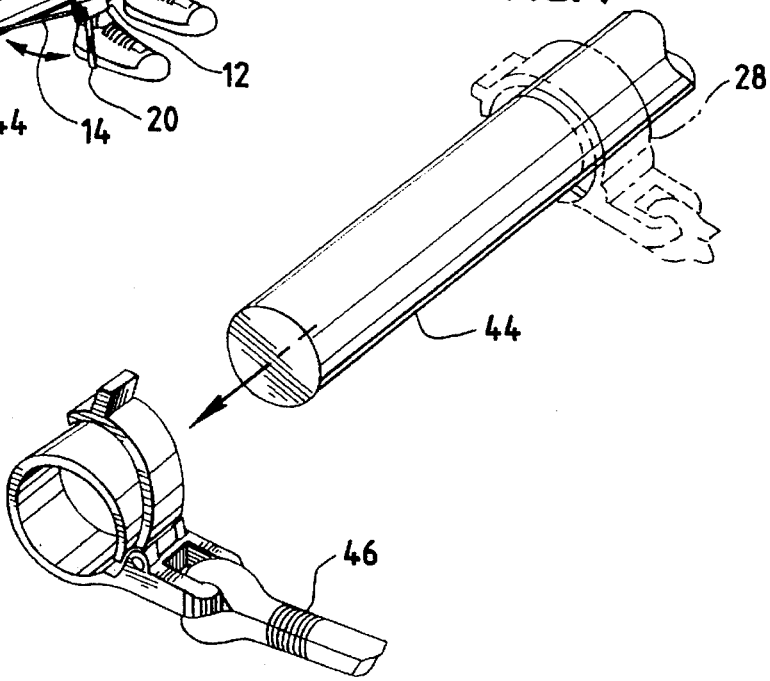
FIG. 7 is a perspective drawing of a quick release mechanism that allows the elastic elements of the device to be cooperatively affixed to the elongated bar.

FIG. 7 shows a close up perspective of a quick release ring attachment that can be affixed to the elongated bar 44 or may be used to cooperatively affix the device to a handle mechanism shown generally as 30.

Although a preferred embodiment of the invention has been disclosed herein for illustration purposes, it should be understood that various changes, modifications and substitutions may be incorporated in such embodiment without departing from the spirit of the invention which is defined by the claims which follow.

I claim:

1. A therapeutic exercise device for maintaining the lateral alignment of exercised limbs, said exercise device comprising:

an adjustable ankle harness comprising an ankle encircling band having first and second ends for joining together;

a heel loop fixed across a bottom portion of said ankle encircling band;

a plurality of elastic elements, said elements each having a lower end and an upper end, said lower end of a first one of said elastic elements being disposed with said ankle encircling band at a top portion thereof, said lower end of a second one of said elastic elements being disposed with said ankle encircling harness at a top portion thereof and opposite said first element wherein said first and second elements are disposed directly across from each other on said ankle encircling band; and a handle disposed at the upper end of each of said first and second elastic elements.

2. The exercise device of claim 1 wherein said first and second ends of said ankle encircling band further comprises a quick release mechanism fixed to each said first and second ends.

3. The exercise device of claim 2 wherein each said quick release mechanism comprises velcro.

4. The exercise device of claim 1 wherein said ankle encircling band further comprises first and second quick attachment means for attaching to said first and second elastic elements, wherein each said lower end of said first and said elastic elements further comprises a quick release means for releasably attaching to said first and second quick attachment means, respectively.

5. The exercise device of claim wherein each said handle is substantially rigid and further comprises means for rotatably attaching each said handle to said upper ends of said first and second elastic elements respectively.

6. The exercise device of claim 1 wherein each said first and second elastic elements comprise differing tensions.

7. The exercise device of claim 6 wherein the tension of one of said first and second elastic elements has a pull to stretch ratio which requires about 1.2 pounds to about 4.5 pounds of force to approximately double the length of said one elastic element.

8. The exercise device of claim 6 wherein the tension of one of said first and second elastic elements has a pull to stretch ratio which requires approximately 6.0 pounds to approximately 12.0 pounds of force to approximately double the length of said one elastic element.

9. The exercise device of claim 1 wherein said elastic elements further comprises means for adjusting the length of said elastic elements.

10. The exercise device of claim 9 wherein said means for adjusting the length of said elastic elements comprises a buckle.

11. The exercise device of claim 9 wherein said means for adjusting the length of said elastic elements comprises a spring-loaded locking spool.

12. The exercise device of claim 1 further comprising an elongated bar comprising first and second rings for receiving the handles of said first and second elastic elements.

13. The exercise device of claim 1 wherein the elongated bar further comprises a spring-loaded telescopic mechanism.

14. The exercise device of claim 1 further comprising an elongated bar comprising first and second grooves for receiving the handles of said first and second elastic elements.

* * * * *